United States Patent [19]

McElwee

[11] Patent Number: 4,519,522

[45] Date of Patent: May 28, 1985

[54] APPARATUS AND METHOD FOR STORING AND RETRIEVING ARTICLES

[75] Inventor: J. Russell McElwee, Charlotte, N.C.

[73] Assignee: Photo Vending Corporation, Charlotte, N.C.

[21] Appl. No.: 280,502

[22] Filed: Jul. 6, 1981

[51] Int. Cl.[3] ..... G07F 11/00

[52] U.S. Cl. ..... 221/13; 364/479; 235/462; 221/79; 414/273; 414/486

[58] Field of Search ..... 414/136, 273, 486; 340/825.35; 209/583, 584; 235/454, 462, 375; 186/56; 221/1, 13, 12, 9, 80, 79, 120, 121; 364/478, 479

[56] References Cited

U.S. PATENT DOCUMENTS

| | | | |
|---|---|---|---|
| 3,166,214 | 1/1965 | Stevens et al. | 221/120 |
| 3,490,616 | 1/1970 | Castaldi | 414/273 |
| 3,563,395 | 2/1971 | Gary | 414/136 |
| 3,697,680 | 10/1972 | Austin | 414/273 |
| 3,732,546 | 5/1973 | Ronkin et al. | 414/136 |
| 3,752,312 | 8/1973 | Soltanoff | 209/583 |
| 3,840,103 | 10/1974 | Willis | 414/136 |
| 3,947,817 | 3/1976 | Regua | 235/454 |
| 3,958,102 | 5/1976 | Burt | 414/273 |
| 4,136,821 | 1/1979 | Sugiura et al. | 235/454 |

*Primary Examiner*—H. Grant Skaggs

*Attorney, Agent, or Firm*—Bell, Seltzer, Park & Gibson

[57] ABSTRACT

This invention relates to an apparatus and method for storing a plurality of articles, each of a different characteristic or nature, and for selectively retrieving and dispensing from the plurality of stored articles any particular desired article when an identification number or code for that particular article is entered. In the embodiments illustrated, each article is provided with a separate and distinct electronically readable optical identification code which can be read directly from the article or a claim check when the article is loaded into the machine or retrieved from the machine.

14 Claims, 16 Drawing Figures

Fig-10
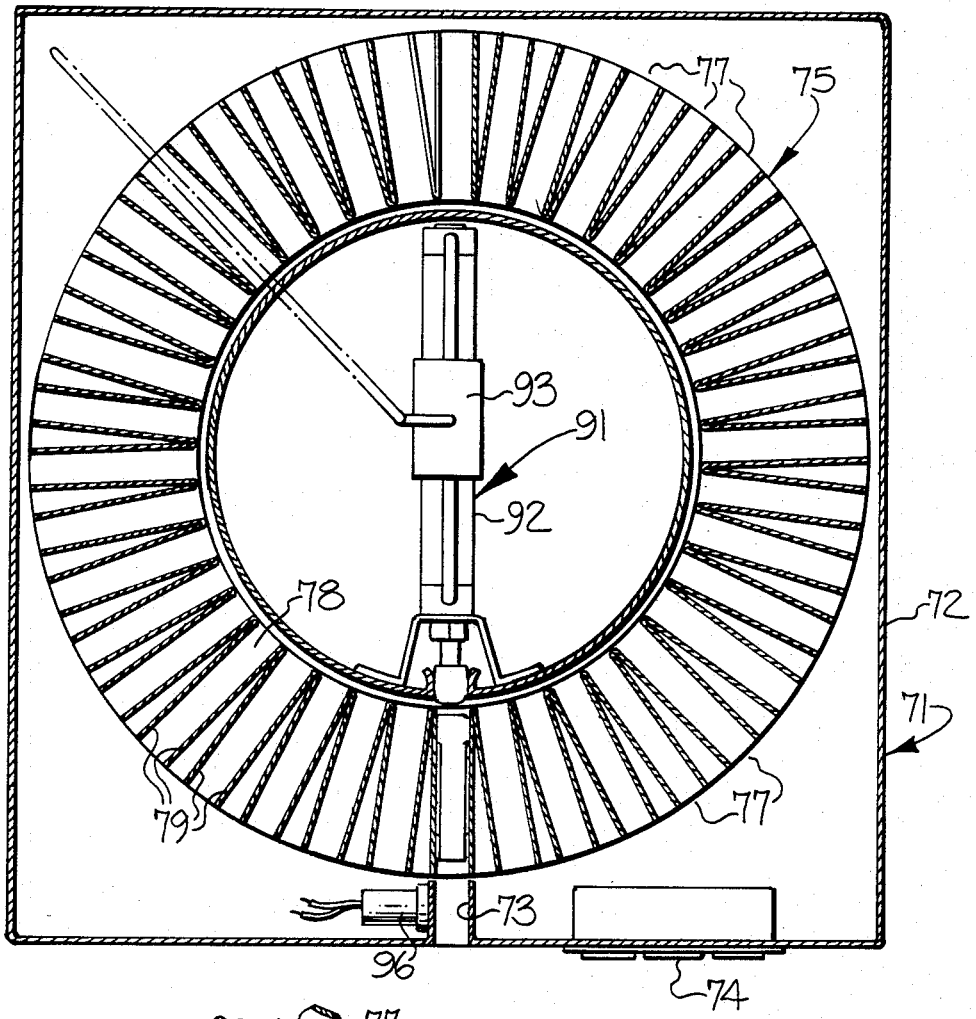
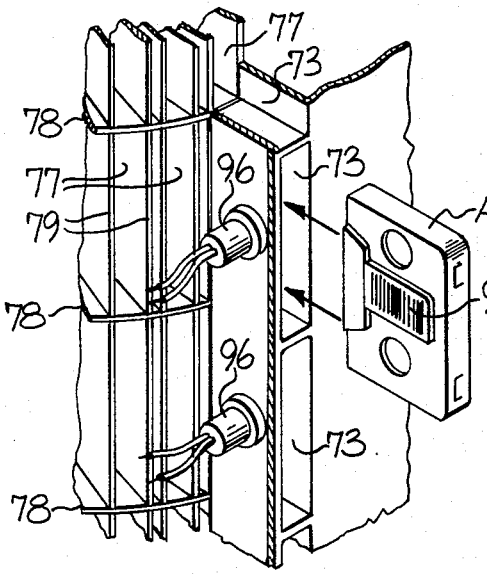
Fig-11

APPARATUS AND METHOD FOR STORING AND RETRIEVING ARTICLES

BACKGROUND OF THE INVENTION

This invention relates to a system for storing and dispensing articles, and more particularly relates to an apparatus and method for storing a plurality of articles each of a different characteristic or nature and for selectively retrieving and dispensing from the plurality of stored articles any particular desired article.

This invention is useful in a variety of applications where articles having unique characteristics are to be stored and it is desired to selectively retrieve or dispense any particular one of the stored articles. One application in which the present invention is particularly useful is in the storage and automated retrieval, without the necessity of clerk involvement, of distinctive articles of personal property. In instances where articles such as photographic film, watches, shoes, jewelry, etc. are left for processing or repair, the present invention may be used to provide for self-service retrieval of the articles by the owners after the processing or repair has been completed. Another particularly useful application of the apparatus and method of the present invention is in the storage and selective retrieval of articles similar in appearance but containing unique data or information, such as reels or cassettes of microfilm, magnetic tape, etc.

A characteristic feature of the apparatus and method of this invention is that each of the articles stored therein is distinctly different from all other articles. In this respect, the invention is different from the usual types of vending machines which are designed for storing one or more groups of articles, with all of the articles in each group being substantially identical.

While machines have been proposed heretofore for carrying out somewhat similar functions as those addressed by the present invention, the machines of the prior art have certain disadvantages or limitations which significantly limit their usefulness. For example, Gehrky U.S. Pat. No. 2,997,133 and Willis U.S. Pat. No. 3,840,103 disclose machines adapted for the self-service vending of garments, such as dry cleaning. The garments are placed on respective individual lugs of a conveyor chain, with each lug being identified by a particular identification number. When the identification number is entered by the customer, the conveyor chain is moved to bring the desired garment into position for retrieval. In these machines, identification numbers are assigned to the individual lugs upon which the garments are placed. Thus, only a limited number of identification numbers are available. This presents a security problem since it becomes necessary to reuse the identification numbers, and someone having knowledge of the identification numbers from prior use of the machine could gain unauthorized access to the garments stored in the machine.

A significant feature of the present invention is that it is capable of using an essentially unlimited number of identification numbers or codes so as to avoid the necessity of reusing the numbers and the security problems presented by such reuse.

A further limitation of the prior machines is that their accuracy in retrieving the correct article depends entirely upon the accuracy of the individual who loads the articles into the machine in placing each article in the correct location corresponding to the identification code for that article. In accordance with the present invention, the identification code for an article is associated directly with the article itself rather than with the particular location where the article is stored, and the system operates to insure that the particular location in which the article is placed for storage is correlated correctly with the identification code of that article. This feature of the invention is particularly advantageous in the latter field of application mentioned above, i.e. the storage and retrieval of cartridges or reels containing unique information or data, where in many instances more than one article may be removed from the machine at one time. The present invention provides for insuring that the correct identification number and location correlation is obtained when the articles are returned to the machine, even though the article may be returned to a different location from that where it was originally obtained.

A further limitation of the prior machines noted above is that the correlation between the identification codes and the corresponding storage locations is preestablished and essentially fixed. In the present invention, on the other hand, the identification code and location correlation is capable of dynamically changing during use of the machine. This capability maximizes use of all available storage locations, since it avoids tying up the use of locations due to the identification code being preassigned. In this regard, it will be understood that in the vending machines of the type described in the aforementioned prior patents, it is necessary that the identification codes either be permanently assigned to a customer, or pre-assigned at the time the garments are deposited for cleaning. In either event, the location corresponding to that identification code is tied up for the entire time the garment is in the possession of the cleaning establishment.

SUMMARY OF THE INVENTION

These and other features and advantages are provided in accordance with the present invention by an apparatus having a plurality of individual receptacles for receiving and storing the articles, and with respective individual articles positioned in the receptacles. Drive means is provided cooperating with the receptacles for moving the receptacles along a predetermined path past a predetermined retrieval point. Respective individual labels are associated with the articles located in each receptacle, with the labels bearing separate and distinct electronically readable identification codes for each article. Means is provided cooperating with the individual labels for electronically reading directly from the labels the identification codes associated with the respective articles, and means is operatively connected to the means for reading the identification codes and to the drive means and is operable for receiving input of the identification code of a particular article which is to be retrieved and for electronically controlling operation of the drive means to effect movement of the receptacles until the particular receptacle containing the desired article is positioned at the retrieval point.

In a preferred embodiment of the invention, the individual labels each bear an identification code which can be electronically read by an optical code reader device, and such a device is provided for reading the optical identification codes associated with the respective articles. Control of the apparatus is preferably achieved electronically by a programmable memory means which is connected to the optical code reader device and which is operable during a loading mode when articles are being loaded into the receptacles for electronically storing in memory the identification code of each article and the corresponding location of the receptacle in which the article is placed. The programmable memory means is operable during a retrieval mode when a desired article is being retrieved for receiving input of the identification code of the article which is to be retrieved and for electronically determining the location of the receptacle containing that particular article and controlling operation of the drive means to move the receptacles until the particular receptacle containing the desired article is positioned at the retrieval point.

A further aspect of the present invention resides in a method for storing a plurality of articles each of a different characteristic or nature and for selectively retrieving from the stored articles any particular desired article. This method comprises labeling an article with an electronically readable identification code which is separate and distinct for that particular article, positioning the article into one of a plurality of receptacles which are mounted for movement along a predetermined path while establishing a correlation between the identification code associated with that article and the corresponding location of the receptacle in which the article is placed. Retrieval of an article is accomplished by electronically receiving input of the identification code of the desired article from suitable means such as a data entry keyboard or an optical code reader device and electronically determining from said correlation the particular receptacle in which the desired article is stored and in response thereto electronically controlling movement of the receptacles past a predetermined retrieval point until the particular receptacle containing the desired article is positioned at the predetermined retrieval point.

In accordance with one aspect of the invention, the correlation between the identification codes associated with the articles and the corresponding locations of the receptacles in which the articles are placed is achieved by electronically reading from each labeled article the particular identification code for that article and storing in a memory the identification code of that article and the corresponding location of the particular receptacle in which the article is placed. The step of electronically determining from the correlation the particular receptacle in which the desired article is stored is achieved by electronically retrieving from the memory the location of the particular receptacle which corresponds to the identification code which is input at the time of retrieval.

In another embodiment of the invention, the correlation is established by positioning the label bearing the identification code for the article in close physical association with the article at the receptacle in which the article is placed and in an orientation for being read during movement of the receptacle. The step of determining from the correlation the particular receptacle in which the article is stored comprises moving the receptacles past the predetermined retrieval point while electronically reading directly from the labels the respective identification codes of the articles and while electronically comparing the identification codes which are read with the identification code which has been input for the desired article until a match occurs and thereupon stopping movement of the receptacles with the article bearing the identification code corresponding to the entered code positioned at the retrieval point.

A further aspect of the present invention resides in a method for storage and automated retrieval of an article which has been left for processing. This method comprises providing an article which is to be processed with an identification label bearing a separate and distinct electronically readable optical identification code for that article and leaving the article for processing while retaining a claim check also bearing the same electronically readable optical identification code. Subsequently, the article is processed and is thereafter placed, along with the identification label bearing the distinct optical identification code for that article, in one of a plurality of receptacles. The method further comprises establishing a correlation between the identification code of the article and the location of the particular receptacle in which the article was placed. Retrieval of the article is achieved by electronically reading the optical identification code from the claim check and electronically determining from the previously established correlation the location of the particular receptacle in which the article associated with that identification code is stored, and electronically controlling movement of the receptacles successively past a predetermined retrieval point until the particular receptacle containing the desired article is positioned at the retrieval point.

BRIEF DESCRIPTION OF THE DRAWINGS

Some of the features and advantages of the invention having been stated, others will become apparent as the description proceeds, when taken in connection with the accompanying drawings, in which—

FIG. 10 is a horizontal sectional view of the machine taken substantially along the line 10—10 of FIG. 8;

FIG. 11 is a fragmentary detailed perspective view of a portion of the machine showing how an article is placed into the machine and the identification code for the article is read from the article;

DESCRIPTION OF ILLUSTRATED EMBODIMENTS

The present invention is illustrated and described herein in connection with certain embodiments adapted for specific end use applications. It is to be understood that the reference to specific embodiments is for purposes of illustration and in order to provide a better understanding of how to make and use the invention. From this description, persons skilled in the applicable arts will readily see that the apparatus and method of the invention are useful in a variety of end use applications besides those specifically shown and described, and that various modifications and adaptations can be made to the devices and methods specifically illustrated and described without departing from the spirit and scope of the invention.

Figure 1:
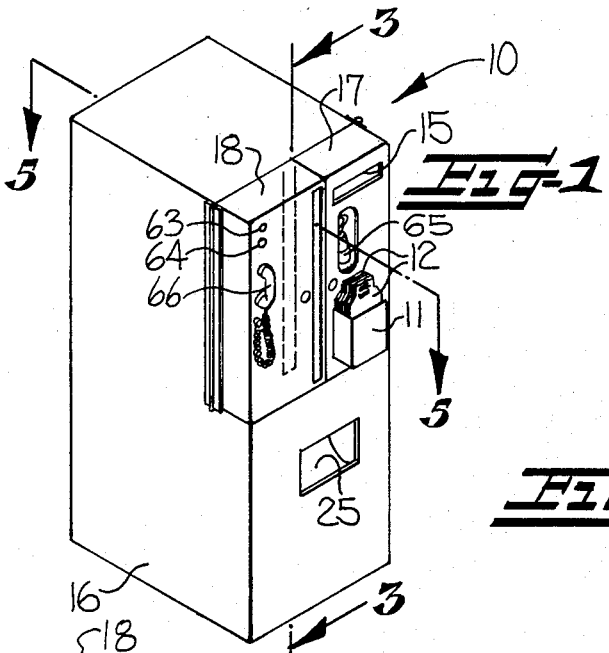
FIG. 1 is a front perspective view of one embodiment of an apparatus in accordance with this invention.

Referring now more particularly to the drawings, FIG. 1 illustrates a machine in accordance with the present invention which is particularly adapted for receiving distinctive articles of personal property which may be deposited for various purposes, such as for processing, cleaning or repair, and for subsequently receiving and storing the processed articles and dispensing a particular desired article when an identification code associated with that particular article is entered. The machine shown in FIG. 1 is generally indicated by the reference character 10, and is particularly designed for receiving undeveloped exposed film which a customer may deposit for processing and for thereafter delivering to the customer in an automated manner, without the necessary clerk involvement, the corresponding finished photographic materials after processing has been completed. To this end, the machine may be conveniently provided with a holder 11 containing a supply of envelopes 12 in which customers may leave the undeveloped exposed film. Each envelope has a identification code or number provided thereon which is separate and distinct from the identification codes and on all other envelopes.

Figure 4:
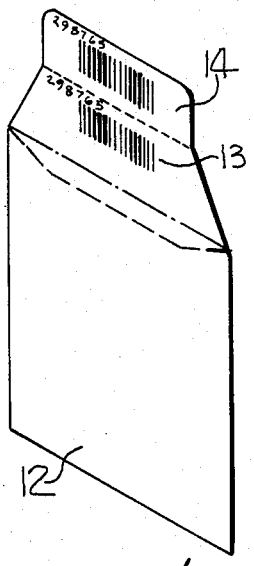
FIG. 4 is a perspective view showing an envelope of the type which may be suitably used for storing and retrieving articles in the machine.

As shown in more detail in FIG. 4, the envelope 12 is provided with a label 13 bearing a suitable electronically readable optical identification code, shown in the form of a standard printed optical bar code pattern. Attached to the envelope 12 and forming a part thereof is a detachable claim check 14 having printed thereon an optical readable bar code pattern with the same identification code as is provided on the label 13. In leaving film for processing, a customer enters appropriate identification information and instructions on the envelope 12, places the film inside the envelope, and detaches and retains the claim check 14. The envelope containing the film is then deposited in a suitable deposit slot 15 (FIG. 1) provided on the machine 10. Periodically, the envelopes containing the exposed undeveloped film are collected from the machine and taken to a processing plant. The processed photographic materials are thereafter returned to the same machine and placed therein so that they can be retrieved by the customer.

Figure 2:
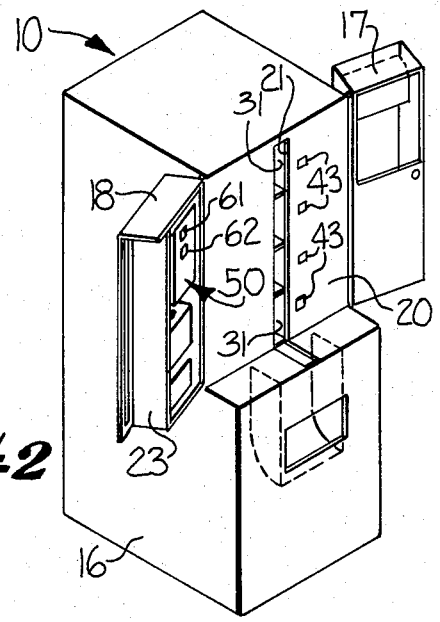
FIG. 2 is a view similar to FIG. 1, but with the front panels of the machine opened to provide access to the interior of the machine for refilling.

Referring now more particularly to the construction of the machine, it will be seen that the machine is of a generally rectangular upright configuration having a generally rectangular housing 16. A pair of front panels 17, 18 are hingedly connected to the housing 16 and swing outwardly as shown in FIG. 2 to provide access to the interior of the machine for loading.

An inner front wall 20 located behind the front panels 17, 18 has an elongate vertically oriented slot-like access opening 21 serving as a retrieval point and providing access to the interior of the machine where a rotatable storage unit 30 (FIG. 3) is located. One of the front panels 17 of the machine serves as a receptacle for receiving and collecting the envelopes which have been deposited through the deposit slot 15. On the other front panel 18 there is mounted certain control circuitry, as will be described in more detail hereinafter, for controlling operation of the machine. The front panels 17, 18 have rearwardly projecting walls 22, 23 which, when the panels are closed, are positioned in opposing relation and cooperate to form an elongate vertically oriented chute or passageway 24 aligned with the slot-like access opening 21 for receiving an envelope which is being retrieved from the machine. During the retrieval operation, the selected envelope is ejected from the storage unit located behind the inner front wall 20, and is pushed through the slot-like access opening 21 and into the passageway 24, as shown in FIG. 3, where it falls by gravity to a receiving hopper 25 at the lower end of the passageway.

Figure 3:
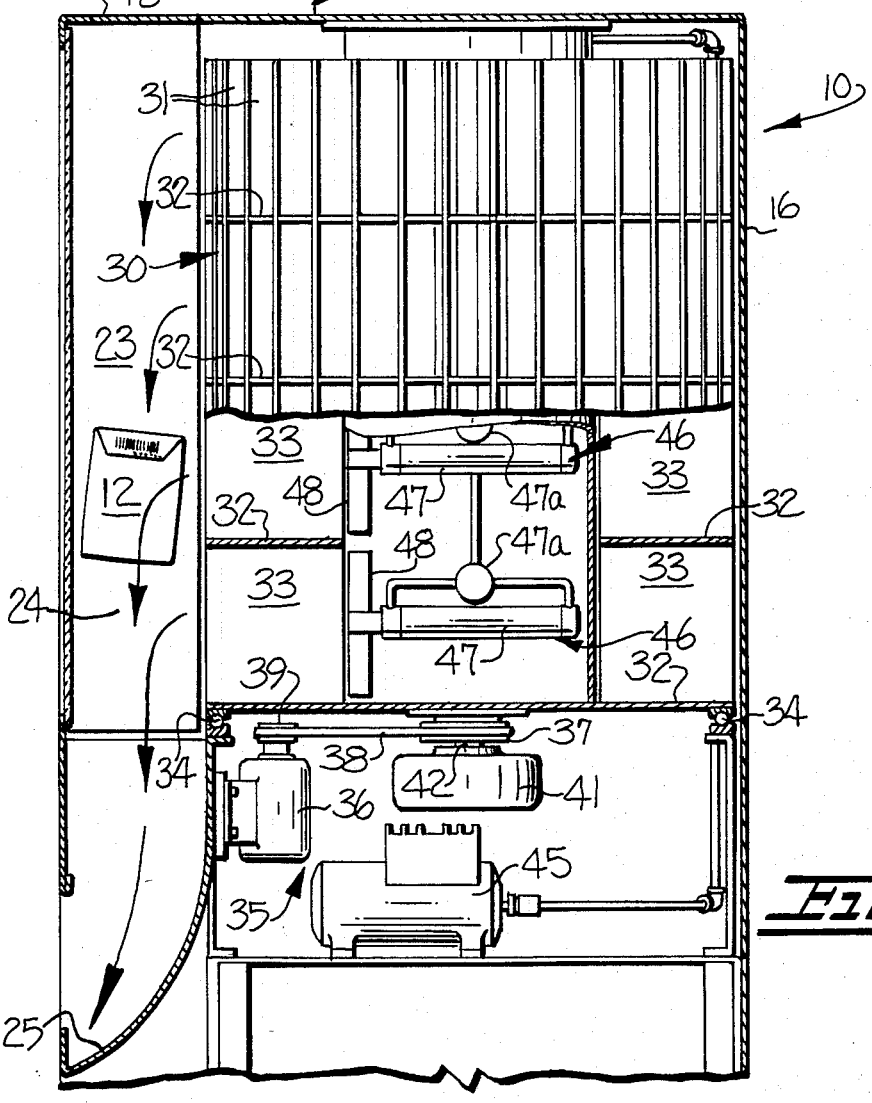
FIG. 3 is a vertical sectional view of the machine taken substantially along the line 3—3 of FIG. 1.
Figure 5:
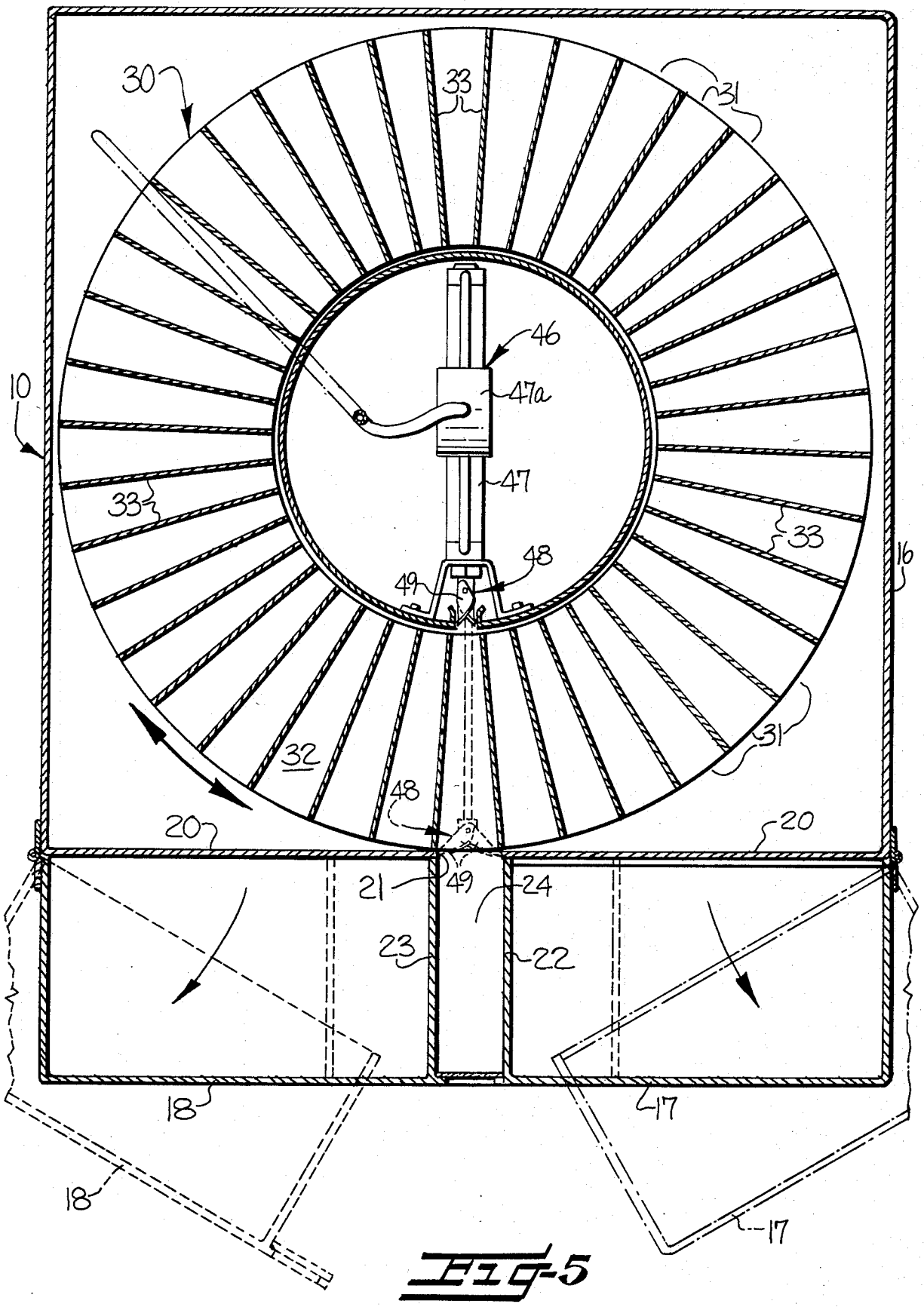
FIG. 5 is a horizontal sectional view of the machine taken substantially along the line 5—5 of FIG. 1.

As best seen in FIGS. 3 and 5, the storage unit, generally indicated at 30, is of a generally cylindrical configuration and contains a plurality of receptacles 31 adapted for receiving and storing the envelopes 12 therein. More particularly, the storage unit 30 includes a series of generally horizontally oriented walls 32 of a generally circular configuration and a series of upright, generally vertically oriented partitions 33 extending radially outwardly from the central axis of the storage unit. The receptacles 31 are thus arranged in plurality of vertically oriented rows and in vertically spaced-apart tiers defined by the walls 32, with all of the receptacles 31 opening along the outer periphery of the storage unit. As illustrated, the storage unit 30 has an open area in the center thereof surrounding the rotational axis of the storage unit within which is mounted respective ejector mechanisms 46 for each tier, as will be described presently. The storage unit is mounted for rotation about the vertically oriented rotational axis by suitable bearings 34. Thus, upon rotation of the storage unit, the respective receptacles are moved along a predetermined path past the slot-like opening 21 which provides access to the storage unit.

Rotation of the storage unit is accomplished by a drive means, generally indicated at 35, which includes a motor 36 located beneath the storage unit, preferably a D.C. stepper motor, a pulley 37 connected to the lower side of the storage unit 30 and a timing belt 38 extending from the pulley 37 to a pulley 39 carried by the shaft of the motor 36. A locator mechanism is also connected to the storage unit 30 and is utilized as hereinafter described for sensing the rotational position of the storage unit. The locator mechanism, more specifically, includes an encoder 41 having a rotatable shaft 42 which is connected directly to the underside of the storage unit 30. The encoder 41 generates a predetermined signal in response to rotation of the shaft 42 thereof. Also located beneath the storage unit in the lower portion of the machine is an air compressor unit 45 for providing a source of compressed air to power the ejector mechanisms, to be described presently.

Figure 6:
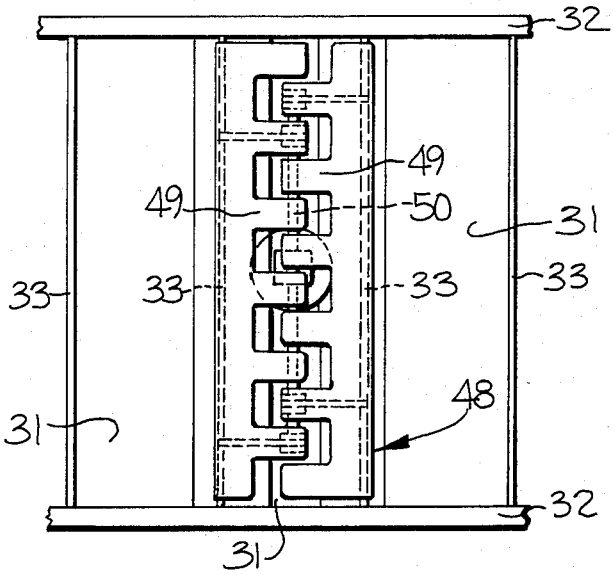
FIG. 6 is an elevational view showing one of the pusher elements used for ejecting articles from the machine.
Figure 7:
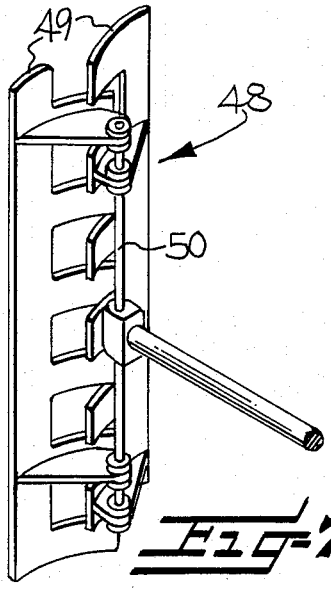
FIG. 7 is a perspective view showing the opposite side of the pusher element.

On each tier of the storage unit there is provided an ejector mechanism, generally indicated at 46 which is adapted for ejecting the envelope positioned in the receptacle located opposite the slot-like opening 21. The ejector mechanism includes a pneumatic cylinder 47, a valve 47*a*, and an ejector head 48 carried by the piston shaft of the pneumatic cylinder 47. The ejector head, as seen in FIGS. 6 and 7, comprises two articulated members 49, which are pivotally mounted from a shaft 50 so that the ejector head can expand in width to compensate for the increasing width of the receptacle in the radially outward direction. This ensures that the envelope or other article contained in the receptacle will be engaged by the ejector head 48 and pushed outwardly from the receptacle upon actuation of the ejector mechanism 46. The operation of the ejector mechanisms on each tier and the operation of the drive means for effecting rotation of the storage unit are governed by a control system 50 mounted inside the front panel 18 of the machine.

Generally, the control system 50 functions as a locator means to establish and maintain a correlation between the identification code for each article and the particular location in which each article is placed in the storage unit. Upon retrieval of an article, when the identification code of that particular article is entered, the control system utilizes the correlation to ascertain the particular receptacle in which the article is located, and controls operation of the drive means 35 to effect rotation of the storage unit 30 until the particular row of receptacles in which the article is located is positioned opposite the slot-like access opening 21, whereupon the ejector mechanism 46 on the particular tier of the storage unit in which the article is located is actuated to thereby eject the article from that receptacle.

Figure 12:
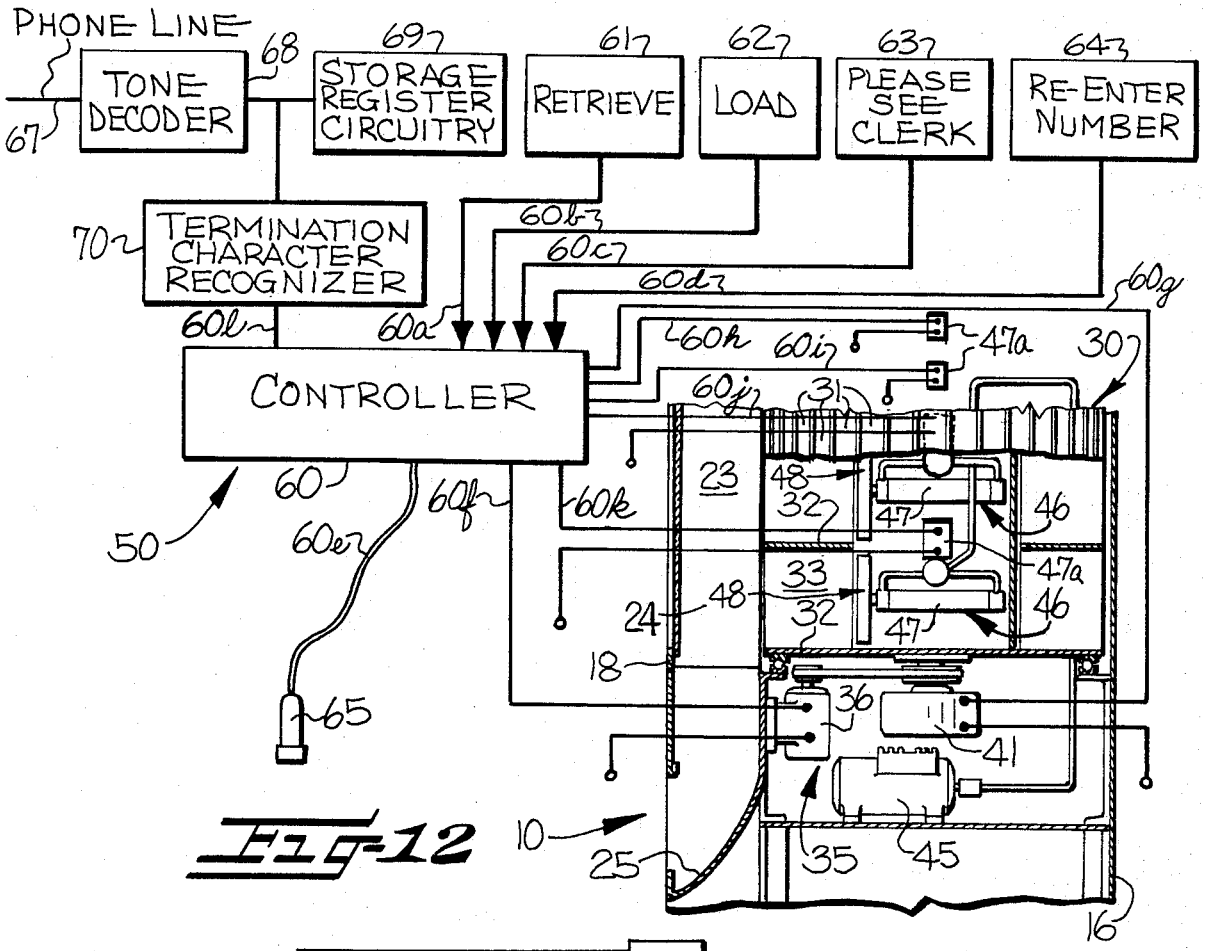
FIG. 12 is a schematic view showing a suitable control circuit for controlling operation of the machine of FIG. 1.

In the embodiment of the invention illustrated, the control mechanism 50 utilizes a microelectronic programmable memory means for maintaining the correlation of the identification codes and the locations of the articles and for controlling the operation of the drive means and the ejector means. The microelectronic programmable memory means is indicated schematically in FIG. 12 by the reference character 60. The memory means 60 is powered by suitable power supply, not shown, and contains a plurality of input-output ports 60*a*–60*e* connected to various elements of the system as described more fully presently. A portion of the memory of the electronic memory means 60 is utilized for storing a correlation table of the identification codes of the respective articles and the corresponding locations in which the articles are stored. Another portion of the memory means 60 is utilized for storing a set of operating instructions which perform manipulations on the correlation table and govern the operation of the input-output ports in the manner to be described presently. From the following description of the functional operation of the memory means 60 and the respective input-output ports 60*a*–60*e*, those of ordinary skill in the art can readily create a set of operating instructions for carrying out the described functions. Accordingly, a detailed description or listing of the particular set of operating instructions is not deemed necessary.

The electronic control system is programmed so as to be operable in one of two modes, either a load mode used when articles are being loaded into the machine, or a retrieve mode used when articles are to be retrieved from the machine. The control system includes two function or mode switches, a retrieve switch 61 and a load switch 62 connected respectively to the ports 60*a* and 60*b*. When the retrieve switch 61 is depressed, the system is placed in the retrieve mode. When the load switch 62 is depressed, the system operates in the load mode. These two mode switches are located on the rear of the front panel 17 so as to be accessible to the operator filling the machine when the front panel is opened, but while being inaccessible to a customer using the machine. Connected to ports 60*c* and 60*d* are two indicators or lights 63, 64 located on the front of the machine and utilized for conveying information to a customer using the machine. An optical code reader wand 65 is connected to port 60*e* and conveys to the memory means 60 a digital code signal containing the information read from the optical bar code labels 13. Port 60*f* is an output port which provides an output signal in the form of a square wave and which is connected to the stepper motor 36 which controls rotation of the storage unit 30. Port 60*g* is an input port which receives a square wave signal generated by the encoder 41 in response to rotational movement of the storage unit 30. In this manner, a feedback signal is provided for maintaining an indication of the rotational position of the storage unit 30. Ports 60*h*–60*k* are output ports which are connected respectively to the ejector mechanisms on each tier of the storage unit. Port 601 is an input port also utilized for receiving digital information of the identification code of an article, as will be described more fully hereinafter.

Operation

The apparatus is loaded with articles by first opening the panels 17, 18 on the front of the machine in order to gain access to the loading openings or windows formed by the elongate slot-like access opening 21. Pressing of the load switch 62 will place the system in a load mode and will cause the storage unit to rotate until the closest empty receptacle becomes available in front of the opening 21. The person loading the machine will then pass the optical code reader or wand 65 across the package label 13 to read the optical identification code of that article into the system, and the package 12 will then be inserted into the empty receptacle. The information read from the package will be stored in the memory and will be associated with the particular rotational position of the receptacle, as determined by the output signal of the encoder 41, and the particular tier of the storage unit. Information concerning the particular tier where the package is placed can be conveyed to the control system by various means. For example, as shown in FIG. 2, a suitable bar code label 43 may be positioned alongside the opening for each tier. After the identification code has been read from the package and the package has been placed in an empty receptacle, the wand 65 can be used to read from the code information from the label 43 corresponding to the tier level of the empty receptacle. After all the information for a particular package has been correctly entered, pressing the load switch 62 will cause the storage unit 30 to rotate until the next available empty receptacle is positioned for loading. The storage unit will not advance until the information has been correctly read into the system.

The above steps will be repeated until the loading process is complete, at which time the operator will depress the retrieve switch 61 in order to place the system in the retrieval mode, and the front panels 17, 18 will then be closed.

A package is retrieved by using the wand 65 to read the bar code contained on the claim check 14 previously removed from the envelope 12. Upon reading the coded information, the system will retrieve from the memory the particular location of the receptacle in which the article bearing that identification code is stored. An output signal will be provided to the stepper motor 36 causing the stepper motor to rotate the storage unit. The information obtained from the encoder 41 is used in conjunction with the stored location data to determine the proper direction of rotation of the stepper motor and the number of stepper drive pulses which must be applied to the motor drive circuitry in order to rotate the storage unit to the appropriate position for the retrieval of the package. The encoder 41 also provides continuous feedback to tell the control system when the storage unit has reached the desired position. Once the storage unit has been rotated to the proper position so that the row of receptacles in which the desired article is contained is positioned directly opposite the access slot 21, an output signal will be provided to the appropriate ejector mechanism 46 on the particular tier of the storage unit in which the article is located. Through a suitable relay circuit, not shown, the valve 47*a* associated with the pneumatic ejector cylinder 47 of the appropriate tier will be actuated to push the desired package from the receptacle and into the chute 24. If the information read from the claim check 14 is not correctly entered, an indicator light 64 will request that the customer again read the package claim check with the wand. If the memory means 60 has no record of a particular package being stored, another indicator light 63 will request that the customer consult a clerk or other person available nearby, or to use a telephone link connecting that particular machine to a central records location so that he may receive specific information about his package.

In the illustrated embodiment, the machine is provided with an optional telephone link to a central records location. A telephone handset 66 is provided on the front of the machine which, when lifted from its cradle, provides a connection to the central records office. If a customer has lost his claim check, or has trouble in retrieving his package, the customer, by lifting the handset 66 will be connected to an attendant at the central records office where the customer may supply identification and information concerning the package. The attendant will then look up the customer's identification number and transmit this information directly to the machine via a touch tone phone. Referring again to FIG. 12, the telephone line is indicated by the reference character 67. A tone decoder circuit 68 converts the information transmitted over the telephone line 67 into binary information which, in turn, is stored in a storage register circuit 69. After transmitting the correct identification number, the attendant will terminate the number transmission with a delineation character such as an asterisk "*", which will be recognized by a delineation character recognition circuit 70 and will generate an external interrupt signal to the port 601. In response to the interrupt signal, the system will read from the storage register circuit 69 the identification number of the package, and will thereupon control the stepper motor 36 and pneumatic ejector 46 in the manner previously described.

Figure 8:
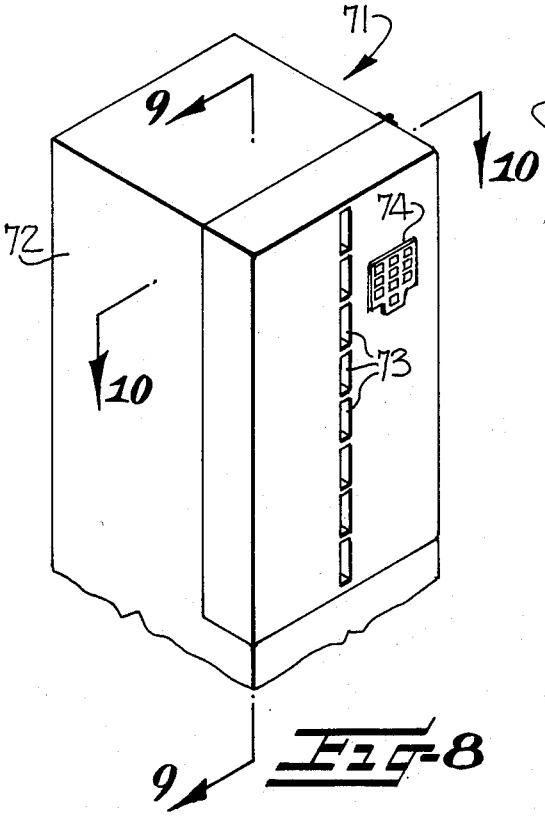
FIG. 8 is a front perspective view of a machine in accordance with a second embodiment of the invention.

An apparatus in accordance with a second embodiment of the invention is shown in FIG. 8 and generally indicated by the reference character 71. This machine is particularly suited for storing and retrieving small articles A of a uniform size, and especially small articles such as cassettes, cartridges or reels containing film or magnetic tape. The machine 71 has a generally rectangular housing 72, on the front side of which is provided a series of vertically aligned slot-like openings 73 into which the articles are placed for storage. A data entry keyboard 74 is provided on the front of the housing which may be used for entering the identification number of an article which is to be retrieved.

Figure 9:
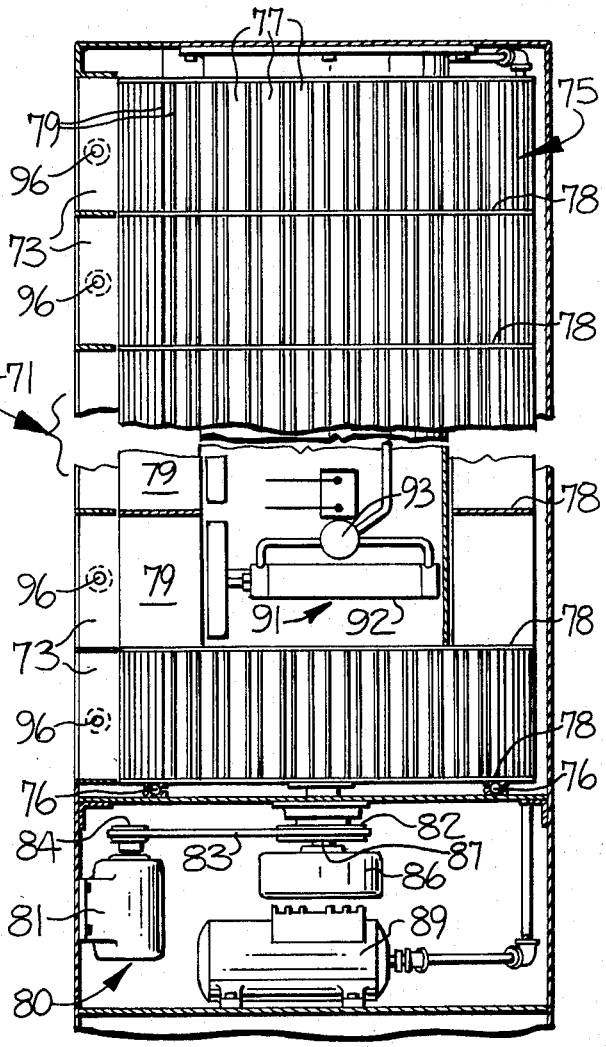
FIG. 9 is a vertical sectional view of the machine taken substantially along the line 9—9 of FIG. 8.

The interior construction of the machine 71 is best understood with reference to FIGS. 9 and 10. As illustrated, a generally cylindrical, upright storage unit 75 is mounted for rotation within the housing about a generally vertically-extending axis on suitable bearings 76. The storage unit is generally similar in construction to the storage unit 30 of the previous embodiment and includes a plurality of radially oriented receptacles or cells 77 arranged in a plurality of tiers and adapted for receiving and storing the respective articles. The respective tiers are defined by a plurality of horizontally-extending walls 78 of a circular configuration with an opening in the center thereof such that the area surrounding the central axis of the storage unit is open. The respective receptacles on each tier are defined by generally radially extending partitions 79. As illustrated, the partitions 79 are of a V-shaped configuration such that adjacent wall portions of the partitions extend in parallel spaced apart relation for receiving an article therebetween. All of the receptacles open along the outer periphery of the storage unit. As in the previous embodiment, a drive means, generally indicated by the reference character 80 is connected to the underside of the storage unit 75 and is adapted for imparting rotation to the storage unit so as to cause the receptacles 77 to move along a predetermined path past the slot-like openings 73 which serve as the retrieval point for retrieving articles from the storage unit or for loading articles therein. The drive means 80 includes a stepper motor 81, a pulley 82 connected to the storage unit 74 and a belt 83 extending between the pulley and a pulley 84 provided on the shaft of the stepper motor 81. Also connected to the storage unit on the underside thereof is a locator means which is adapted for generating a signal for indicating to the control system the rotational position of the storage unit. The locator means includes an encoder 86 having a rotatable shaft 87 which is connected to the storage unit for rotation therewith. Also provided beneath the storage unit in the lower portion of the housing is an air compressor 89. Mounted within the hollow interior portion of the storage unit on each tier is an ejector mechanism 91 adapted for ejecting an article from the receptacle located opposite the access openings 73. Each ejector mechanism 91 includes a pneumatic cylinder 92 and a valve 93 which is connected to the supply of compressed air provided by the compressor 89 and which is electrically connected to the control system for actuation.

As shown in FIG. 11, each article A has a label 95 affixed thereto and bearing an electronically optically readable optical identification code. In the embodiment illustrated, the optical identification code is in the form of a printed optical bar code pattern with a separate and distinct identification code or number for that particular article. Respective individual optical bar code reader devices 96 are mounted on each tier at each access opening 73, with the reader device 96 being oriented for reading the coded information from the label 95 as the article labeled A is being placed through the slot 72 and into the machine.

Figure 13:
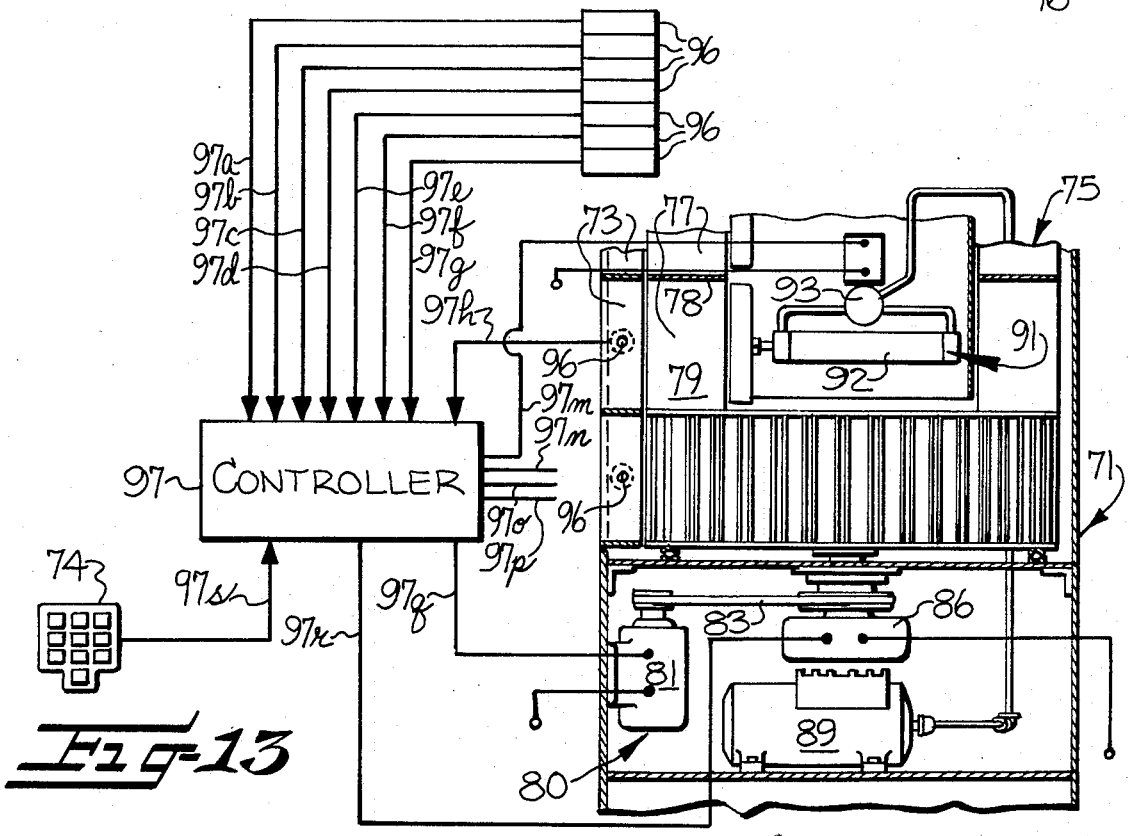
FIG. 13 is a schematic view showing a suitable control circuit for controlling operation of the machine of FIG. 8.

The operation of the machine is controlled by a control device generally indicated at 97 in FIG. 13. In the embodiment illustrated, the control device 97 comprises a microelectronic programmable memory means having a plurality of input/output ports 97*a*–97*l*. Ports 97*a* through 97*h* are connected to the optical code readers 96 on each tier of the storage unit. Ports 97*i* through 97*p* are connected to the respective ejector mechanisms 91 on each tier. Port 97*q* is connected to the stepper motor 81 and provides a series of pulses to the stepper motor for rotating the storage unit to the appropriate position for retrieving a particular desired article. A signal from the encoder 86 is provided back to the control device 97 via port 97*r* and thus provides a feedback loop whereby the system can keep track of the rotational position of the storage unit. The digital data entry keyboard 73 is connected to the control device 97 via port 97*s* whereby the identification number of a particular article to be retrieved can be entered into the system.

The control device 97 has a memory in which is stored a set of operating instructions for carrying out the functions of the controller, and in which is also stored a correlation table between the identification codes for each article and the respective locations of the receptacles in which the articles are stored. The control device 97 is operable in one of two modes, a loading mode and a retrieval mode. Entry of an identification number of an article into the keyboard 73 places the system in the retrieval mode. Thereupon the number entered into the keyboard is compared with the identification numbers stored in the memory to determine the location of the particular receptacle in which the article bearing that identification number is stored. The system then determines the number of pulses which must be provided to the stepper motor 81 in order to cause the storage unit 75 to rotate until the particular receptacle containing that article is positioned opposite the access slot 73. When the storage unit 75 has rotated to the correct position, as verified by the signal from the encoder 86, a signal is provided to the ejector mechanism 91 on the appropriate tier of the storage unit. The pneumatic cylinder 92 is actuated, and the article A is pushed outwardly from its receptacle a short distance to allow it to be easily grasped and removed from the machine by the operator. Following this operation, the system returns to the loading mode so as to be ready to receive this or another article for storage.

When an article is ready to be returned to storage, it is manually placed into an empty access slot 73. As the article A passes in front of the optical code reader on that tier, the identification code from the label 95 carried by that article is read and an interrupt signal is generated which places the system into the load mode. Then the identification code is read into the memory and is stored there along with the rotational position and tier level of the particular receptacle in which the article is being placed.

In accordance with this system, the article can be returned to the empty receptacle from which it was obtained, or to any other available empty receptacle, and more than one article can be removed from the machine for use at a given time. The system insures that when the articles are returned to the machine for storage, the correct identification code and location correlation will be obtained directly from the article as the article is being placed into a receptacle of the machine for storage.

Figure 14:
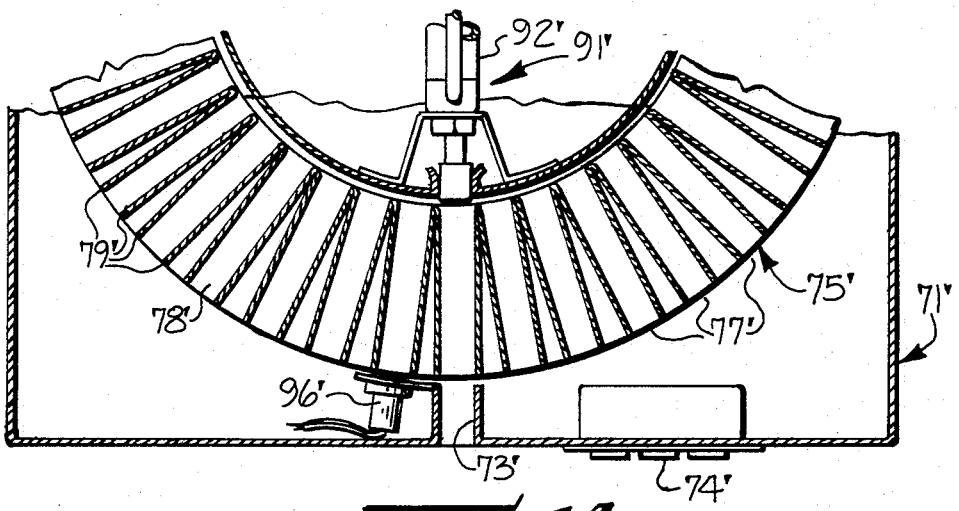
FIG. 14 is a fragmentary horizonal sectional view of a machine constructed in accordance with still another embodiment of the invention.
Figure 15:
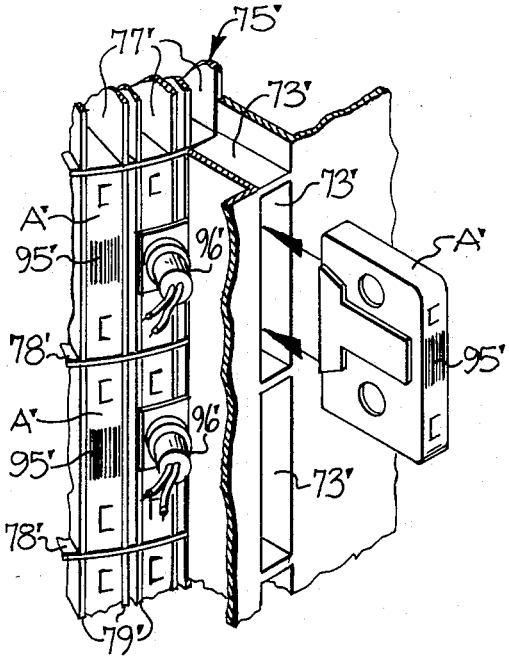
FIG. 15 is a fragmentary perspective view of the front of the machine showing how articles are placed into the machine and the identification code for the article is read from the article.

FIGS. 14–15 illustrate a machine in accordance with still another embodiment of the invention. This machine is of a construction quite similar of that of the previous embodiment illustrated and described in connection with FIGS. 8–13. To avoid repetition, elements of the apparatus which correspond to elements present in the previous embodiment and previously described in connection therewith will be identified by corresponding reference characters wherever applicable, with prime notation (′) added. Basically, the fundamental difference between the machine of this embodiment and that of the previous embodiment resides in the particular control system by which the articles are identified and located. In both of these embodiments there is established a correlation between the identification codes of each article and the corresponding location of the receptacle in which the article is placed, and this correlation is utilized for locating the desired article when the corresponding identification code of that particular article is entered into the machine. In the previous embodiment, this correlation was produced by electronically reading from each labeled article the particular identification code for that article and storing that identification code in a memory along with the corresponding location of the particular receptacle in which the article is placed. The step of determining from the correlation the particular receptacle in which the article is stored is accomplished electronically by retrieving from the magnetic memory the location of the particular recepticle which corresponds to the input identification code. In the embodiment illustrated in FIGS. 14–16, the correlation between the identification code of an article and the particular storage location for that article is accomplished physically. Specifically, the label bearing the identification code for the article is located in close physical association with the article at the receptacle in which the article is placed. This can be suitably accomplished by applying the label bearing the identification code directly to the article while placing the article and its label in a receptacle and in an orientation for being read during movement of the receptacle. Alternatively, for irregular shaped articles, the label for the article can be placed in a close proximal position to the article, such as on a label holder device positioned adjacent to the receptacle in an orientation permitting the label to be read during movement of the receptacle. The step of determining from the correlation the particular receptacle in which the article is stored is carried out by entering the identification code of the article which is to be retrieved and moving the receptacles past a reader device while electronically reading directly from the labels the respective identification codes of the articles and while electronically comparing the identification codes which are read from the articles with the entered identification code until a match occurs and thereupon stopping movement of the receptacles with the article bearing the entered identification code positioned at a predetermined retrieval point.

Referring more particularly to FIG. 14 and 15, the optical bar code reader device 96′ for each tier is mounted adjacent to the access opening 73′ for that tier and is adapted for reading directly from the labels 95′, the identification codes for the articles as the storage unit rotates past the code reader device 96'. Articles A' are placed in the machine in any random fashion so long as the labels 95' are oriented outwardly so as to be capable of being read by the reader device.

When an article A' is to be retrieved from the machine, the particular identification code for that article is entered into the machine by a suitable means, such as a data entry keyboard 74'. Entry of the identification code actuates the drive means, the storage unit 75' begins to rotate so as to move the articles on each tier successively past the optical code reader device 96' for that tier. As each article moves past the reader device, the identification code from the label 95' is read by each reader device and this code is compared with the identification code of the desired article. When an article is located bearing an identification code matching that which was entered at the keyboard 74', the drive motor 81' is stopped with the row of receptacles in which that article is contained located directly opposite the access opening 73', and the ejector mechanism 91' on the particular tier in which that article is located is actuated so as to move the article outwardly from the receptacle a short distance to allow it to be easily grasped and removed from the machine by the operator.

Figure 16:
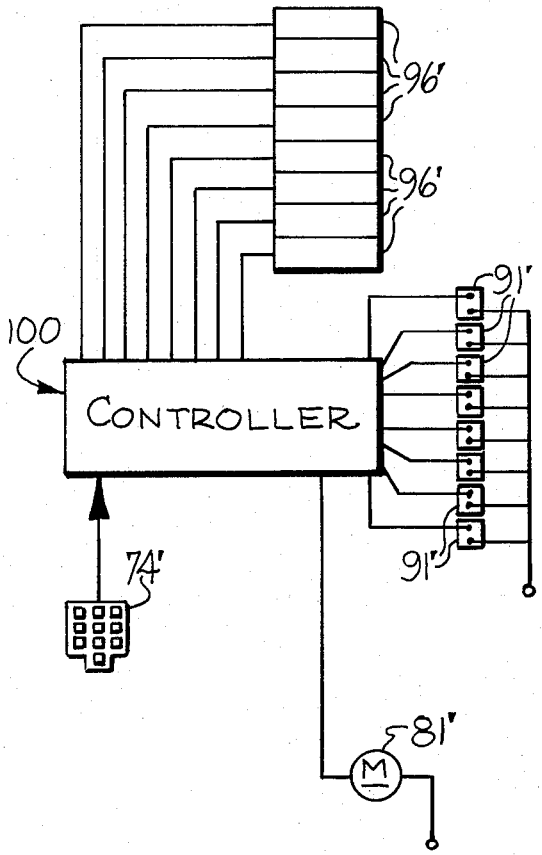
FIG. 16 is a schematic view showing a suitable control circuit for controlling operation of the machine of FIG. 14.

The control circuitry for this embodiment of the invention is illustrated schematically in FIG. 16. As shown therein, the keyboard 74', the drive motor 81', and the ejector mechanisms 91' for each tier are connected to a control unit indicated schematically by the reference character 100. The respective optical code reader devices 96' for each tier are also connected to the control unit 100. Provided within the control unit 100 is a comparator circuit for each tier which receives input of the identification code read from the optical code reader 96' for that tier and compares that identification code with the code input to the keyboard 73'. When a match occurs, the comparator circuit causes the drive motor 81' to stop after a predetermined delay time correlated with the speed of rotation of the storage unit 75' so that the particular article is allowed to move from the location of the reader device 96' to the location of the access opening 73'. After the storage unit 75' has stopped with the desired article located at the access opening 73', the ejector mechanism 91' for the particular tier where the desired article is located is actuated.

In the drawings and specification there have been set forth several exemplary embodiments of the invention. It will be appreciated that various changes can be made within the scope of this invention and that the novel features of the present invention can be embodied in various arrangements other than those specifically described and illustrated. Although specific terms are employed herein, they are used in a generic and descriptive sense only and not for purposes of limitation.

That which is claimed is:

1. Apparatus for storing a plurality of articles each of a unique characteristic or nature, and for selectively retrieving from the plurality of stored articles any particular desired article upon receiving input of an identification code associated with that particular unique article, said apparatus comprising a rotatably mounted storage unit having a plurality of receptacles therein for receiving and storing the respective articles, drive means operatively connected to said storage unit for rotating the same so as to move the receptacles past a predetermined retrieval point, respective individual articles positioned in the receptacles, individual label means associated with the respective articles stored in said receptacles, each bearing a separate and distinct electronically readable identification code for a particular article which uniquely identifies that article and distinguishes it from all others and which has no pre-established correlation to the location of the receptacle in which the article is positioned, means for electronically reading directly from said individual label means the identification codes associated with the respective articles, and programmable memory means operatively connected to said means for reading the identification codes and to said drive means and including means operable during a loading mode when articles are loaded into the receptacles for electronically storing in the programmable memory means the identification codes of the articles and the corresponding locations of the receptacles in which the articles are placed to thereby establish during the loading mode a correlation between the identification code and the receptacle location for each stored article, and including means operable during a retrieval mode when a desired article is being retrieved for receiving input of the specific identification code of a particular article which is to be retrieved and for electronically controlling operation of said drive means by reference to said correlation in the programmable memory means to effect movement of the receptacles past said retrieval point until the particular receptacle containing the desired article having said specific identification code is positioned at the retrieval point.

2. Apparatus according to claim 1 wherein the electronically readable identification codes borne by said label means comprise optical codes, and wherein said means for electronically reading the identification codes of the labeled articles comprises an optical code reader device.

3. Apparatus according to claim 2 wherein said means operable during a retrieval mode for receiving input of the identification code comprises said optical code reader device.

4. Apparatus according to claim 2 wherein said means operable during a retrieval mode for receiving input of the identification code comprises a data entry keyboard.

5. Apparatus for storing a plurality of articles each of a unique characteristic or nature, and for selectively retrieving from the plurality of stored articles any particular desired article upon receiving input of an identification code associated with that particular unique article, said apparatus comprising a storage unit mounted for rotation about a predetermined axis and having a plurality of partitions extending radially outwardly from said axis and defining a plurality of radially oriented receptacles adapted for receiving and storing the respective articles therein, drive means operatively connected to said storage unit for rotating the same so as to move the receptacles past a predetermined retrieval point, individual label means associated with each of the articles stored in the apparatus and bearing a separate and distinct electronically readable optical identification code for each article which uniquely identifies that article and distinguishes it from all others, an optical code reader device cooperating with said individual label means for electronically reading the optical identification codes associated with the respective articles, and programmable memory means connected to said optical code reader device and being operable during a loading mode when articles are loaded into the receptacles for electronically storing in the programmable memory means the identification code of the article and the corresponding location of the receptacle in which the article is placed to thereby establish during the loading mode a correlation between the identification code and the receptacle location for each stored article, and being operable during retrieval mode when a desired article is being retrieved for electronically receiving input of the identification code of the article which is to be retrieved and for electronically controlling operation of said drive means by reference to said correlation in the programmable memory means to cause the drive means to rotate the storage unit until the particular receptacle containing the desired article is positioned at the retrieval point.

6. Apparatus according to claim 5 wherein said programmable memory means includes means cooperating with said optical code reader device during said retrieval mode for electronically receiving from said optical code reader device said input of the identification code of the article which is to be retrieved.

7. Apparatus according to claim 5 additionally including a data entry keyboard, and wherein said programmable memory means includes means cooperating with said data entry keyboard during said retrieval mode for electronically receiving from said keyboard said input of the identification code of the article which is to be retrieved.

8. Apparatus for storing a plurality of articles each of a unique characteristic or nature, and for selectively retrieving from the plurality of stored articles any particular desired article upon receiving input of an identification code associated with that particular unique article, said apparatus comprising a cylindrical storage unit mounted for rotation about a generally vertically oriented axis, said storage unit having a series of spaced apart horizontally oriented walls defining a plurality of vertically spaced tiers, and having a plurality of vertically oriented partitions on each tier extending radially outwardly from said axis and cooperating to define a plurality of vertically aligned rows of radially oriented receptacles opening along the outer periphery of the storage unit and adapted for receiving and storing the respective articles therein, drive means operatively connected to said storage unit for rotating the same so as to move the receptacles past a predetermined retrieval point, locator means connected to said storage unit and operable for generating a signal for indicating the particular row of receptacles located at said retrieval point, respective individually actuable ejector means on each tier for ejecting an article from the receptacle on that tier located at said retrieval point, individual label means associated with each of the articles stored in the apparatus and bearing separate and distinct electronically readable optical identification codes for each article which uniquely identifies that article and distinguishes it from all others, an optical code reader device cooperating with said individual label means for electronically reading the optical identification codes associated with the respective articles, programmable memory means connected to said optical code reader device, to said drive means, and to said locator means and being operable in either a loading mode used when articles are being loaded into the receptacle or a retrieval mode used when a desired article is being retrieved, said programmable memory means, when operating in the loading mode, including means responsive to said optical code reader device and to the signal generated by said locator means for electronically storing the identification code of the article and the corresponding location of the receptacle in which the article is placed in the programmable memory means to thereby establish during the loading mode a correlation between the identification code and the receptacle location for each stored article, and said programmable memory means, when operating in the retrieval mode, including means operable for electronically receiving input of the identification code of an article which is to be retrieved and for electronically determining from the stored correlation of identification codes and receptacle locations in the programmable memory means the location of the receptacle containing that particular article and for controlling operation of said drive means to cause the drive means to rotate the storage unit until the particular row of receptacles containing the desired article is positioned at the retrieval point and for controlling operation of said ejector means so as to actuate the ejector means on the particular tier where the desired article is located.

9. A method for storage of a plurality of articles of a unique nature and automated retrieval of a particular desired article, said method comprising labelling each article which is to be stored with a label bearing a separate and distinct electronically readable optical identification code for that article which uniquely identifies that article and distinguishes it from all others, placing each article which is to be stored in a respective individual receptacle mounted for movement along a predetermined path while positioning the optical identification code for the article in an orientation accessible for reading and while moving the article past an optical code reader device and electronically reading directly from the label the optical identification code for that article and electronically storing in a memory the identification code of the article and the corresponding location of the particular receptacle in which the article is placed, retrieving a selected article by electronically receiving input of the identification code for that article and electronically retrieving from the memory the location corresponding to the input identification code and in response thereto effecting movement of the receptacles past a predetermined retrieval point until the particular receptacle containing the desired article is positioned at the retrieval point.

10. A method for storing articles of a unique nature in a storage device having a plurality of individual receptacles mounted for movement past a predetermined retrieval point and for automatically retrieving any particular desired article, said method comprising labeling each article which is to be stored with a label bearing an electronically readable identification code for that particular article which uniquely identifies that article and distinguishes it from all others and which has no pre-established correlation to any of the receptacles in the storage device, selecting any unoccupied receptacle in the storage device and placing the article which is to be stored therein, electronically reading directly from the label of the article which is to be stored the identification code for that article and electronically storing in a programmable memory device the identification code of that article and the corresponding location of the particular receptacle in which the article is placed, and thereafter retrieving any selected article by electronically receiving input of the identification code for that article and electronically retrieving from the programmable memory device the stored receptacle location corresponding to the input identification code and in response thereto effecting movement of the receptacles past said predetermined retrieval point until the particular receptacle containing the desired article is positioned at the retrieval point.

11. A method according to claim 10 comprising the further step of ejecting the article from the receptacle when the particular receptacle containing the desired article is positioned at the retrieval point.

12. A method according to claim 10 wherein said step of electronically receiving input of the identification code of an article comprises entering the identification code with an optical code reader.

13. A method according to claim 10 wherein said step of electronically receiving input of the identification code of an article comprises electronically receiving input of the identification code from a data entry keyboard.

14. A method according to claim 10 wherein said step of labeling comprises applying to the article a label bearing an electronically readable optical identification code, and said step of electronically reading the identification code from the article comprises moving the label and the optical code device relative to one another.

* * * * *